US005488966A

United States Patent [19]

Baldwin et al.

[11] Patent Number: 5,488,966

[45] Date of Patent: Feb. 6, 1996

[54] UMBRELLA CANOPY AND METHOD OF FORMING SAME

[75] Inventors: Blair F. Baldwin, New York, N.Y.; Russell G. Dobrowski, Clinton; Arthur L. Arledge, Basking Ridge, both of N.J.

[73] Assignee: Bexel Corporation, New York, N.Y.

[21] Appl. No.: 330,220

[22] Filed: Oct. 27, 1994

Related U.S. Application Data

[63] Continuation of Ser. No. 33,500, Mar. 18, 1993, abandoned.

[51] Int. Cl.[6] ..... A45B 25/18

[52] U.S. Cl. ..... 135/33.2; 135/15.1

[58] Field of Search ..... 135/33.2, 33.4, 135/33.41; 2/171.03

[56] References Cited

U.S. PATENT DOCUMENTS

| | | | |
|---|---|---|---|
| 67,405 | 8/1867 | Brown | 135/33.2 |
| 1,174,116 | 3/1916 | Berman | 135/33.2 X |
| 1,219,640 | 3/1917 | Howard | 135/33.2 X |
| 3,844,301 | 10/1974 | Harrell . | |
| 4,794,939 | 1/1989 | Okuda | 135/33.2 |
| 4,842,003 | 6/1989 | Baldwin . | |
| 4,966,179 | 10/1990 | Baldwin . | |

FOREIGN PATENT DOCUMENTS

| | | | |
|---|---|---|---|
| 2034669 | 5/1992 | Canada | 135/33.2 |

*Primary Examiner*—Lanna Mai
*Attorney, Agent, or Firm*—Burgess, Ryan and Wayne

[57] ABSTRACT

An umbrella canopy includes a single sheet of web material formed in a closed configuration and having a periphery, said single sheet of web material having a bowed configuration, said single sheet of web material having at least one radially oriented tuck therein which applies a circumferential force on said single sheet of web material to form said single sheet of web material into said bowed configuration, each said tuck extending radially outwardly to said periphery.

16 Claims, 5 Drawing Sheets

UMBRELLA CANOPY AND METHOD OF FORMING SAME

This application is a continuation of application Ser. No. 08/033,500, filed Mar. 18, 1993, now abandoned.

BACKGROUND OF THE INVENTION

The present invention relates generally to umbrellas, and more particularly, is directed to an umbrella canopy and a method of forming the same.

In order for an umbrella canopy to be effective, it is necessary that water not accumulate on the upper surface of the canopy. Otherwise, the weight of the water on the umbrella will render the umbrella difficult to use and may damage the umbrella canopy. Accordingly, umbrella canopies have been provided with a downwardly bowed configuration. Thus, water which impacts on the upper surface of the umbrella canopy runs outwardly in the radial direction, and falls off of the peripheral edge thereof, thereby preventing such accumulation.

This bowed effect has been achieved in two different ways. In a first way, the canopy is manufactured from a plurality of individual segments, much like slices of a pie. Each segment is formed with convex side edges having a length greater than the peripheral edge thereof so that when the side edges of all of the segments are sewn together, a bowed effect is imparted to the canopy. However, such a canopy is complex to manufacture and adds cost to the umbrella. Examples of such canopies are found in umbrellas presently sold under the trademark "TOTES".

In a second way, the canopy is manufactured from a single punched sheet having no bowing effect imparted thereto, but having an elasticity. The bowing effect is imparted by the struts, which apply a force to the canopy so that the canopy assumes the bowed configuration. However, an umbrella using such an arrangement becomes costly and complex to manufacture because of the need for additional struts that impart such bowed configuration to the canopy. Examples of such canopies are disclosed in U.S. Pat. No. 3,844,301 to Harrell; U.S. Pat. No. 4,842,003 to Baldwin et al and U.S. Pat. No. 4,966,179 to Baldwin.

OBJECTS AND SUMMARY OF THE INVENTION

Accordingly, it is an object of the present invention to provide an umbrella canopy and method of forming the same that overcomes the problems with the aforementioned prior art.

It is another object of the present invention to provide an umbrella canopy that is made of a one-piece construction.

It is still another object of the present invention to provide an umbrella canopy that has a bowed configuration without the need for any strut force thereon.

It is yet another object of the present invention to provide an umbrella canopy that is easy and economical to manufacture.

In accordance with one aspect of the present invention, an umbrella canopy includes a single sheet of web material formed in a closed configuration and having a periphery, the single sheet of web material having a bowed configuration, the single sheet of web material having at least one radially oriented tuck therein which applies a circumferential force on the single sheet of web material to form the single sheet of web material into the bowed configuration, each tuck extending radially outwardly to the periphery.

The single sheet is preferably formed into a hexagonal configuration having six peripheral apices, and each tuck extends to a respective the apex of the hexagonal configuration. Further, the single sheet has a center and a symmetrical configuration about the center, and each tuck extends from the center to the periphery. The single sheet has a center opening.

In one modification, each tuck extends from a position between the periphery and the center, to a position at the periphery.

In another modification, the single sheet further includes a plurality of pockets at a lower surface thereof, the plurality of pockets formed from flaps secured to the periphery and folded over and secured to the lower surface.

In accordance with another aspect of the present invention, an umbrella canopy includes a single sheet of web material formed in a closed configuration and having a periphery, the single sheet of web material having a bowed configuration, the single sheet of web material having at least one radially oriented seam therein which applies a circumferential force on the single sheet of web material to form the single sheet of web material into the bowed configuration, each seam extending radially outwardly to the periphery, and the single sheet of material having a central connecting region free of any seam line.

The single sheet of web material has at least one radially oriented cut-away portion which defines an open area having opposite radially oriented edges, and each seam includes a securement of the opposite radially oriented edges of each respective open area. Preferably, each open area has a substantially triangular configuration.

There is further means for securing together the opposite radially oriented edges of each respective the open area.

Again, the single sheet is preferably formed into a hexagonal configuration having six peripheral apices, and each seam extends to a respective the apex of the hexagonal configuration. The single sheet has a center opening.

The single sheet has a center and a symmetrical configuration about the center, and each seam extends from the center to the periphery.

In one modification, the single sheet has a center and a symmetrical configuration about the center, and each seam extends from a position between the periphery and the center, to a position at the periphery.

In accordance with still another aspect of the present invention, a method of forming an umbrella canopy, includes the steps of forming a single sheet of web material in a substantially closed configuration, the single sheet of web material having a periphery; gripping spaced apart, radially oriented portions of the single sheet of web material; pulling the spaced apart, radially oriented portions of the single sheet of web material toward each other to a pulled together position so as to form the single sheet of web material into a bowed configuration; and securing the spaced apart, radially oriented portions of the single sheet of web material in the pulled together position to form one of a radially oriented seam and a radially oriented tuck at each pulled together position which extends radially outwardly to the periphery.

Preferably, there is at least one radially oriented cut-away portion which defines an open area having opposite radially oriented edges in the single sheet of web material, and a radially oriented seam is formed at each pulled together position which extends radially outwardly to the periphery.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
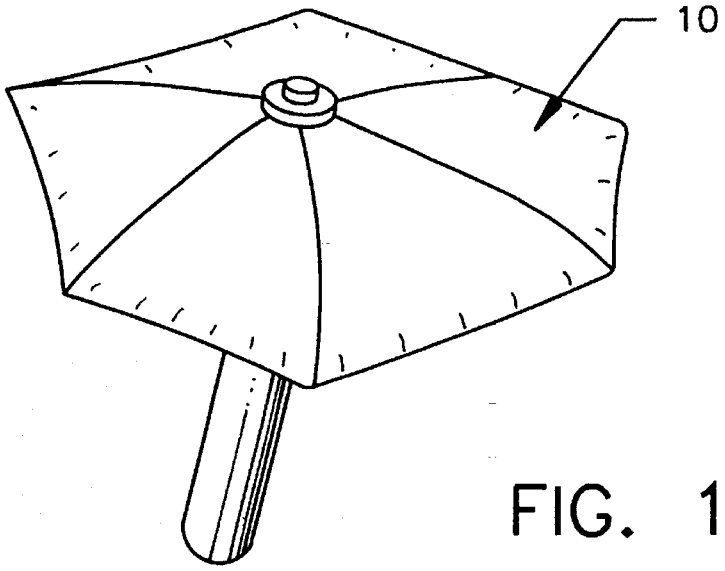
FIG. 1 is a perspective view of an umbrella canopy according to the present invention in a bowed configuration.

Referring to the drawings in detail, and initially to FIG. 1 thereof, there is shown an umbrella canopy 10 according to the present invention. Although umbrella canopy 10 is shown with a hexagonal configuration, the present invention is not limited thereby, and umbrella canopy 10 can be formed with any other suitable configuration, such as a circular, square, pentagonal, octagonal and the like configuration. Thus, although the drawings hereinafter show the various embodiments as having a hexagonal configuration, the present invention is not limited thereby.

In accordance with the present invention, umbrella canopy 10 is formed from a single flat sheet 12 of web material. The web material is of the type conventionally used in umbrella canopies. Therefore, the web material should have a degree of elasticity in order that canopy 10 retains its original shape when stretched and released.

Figure 2:
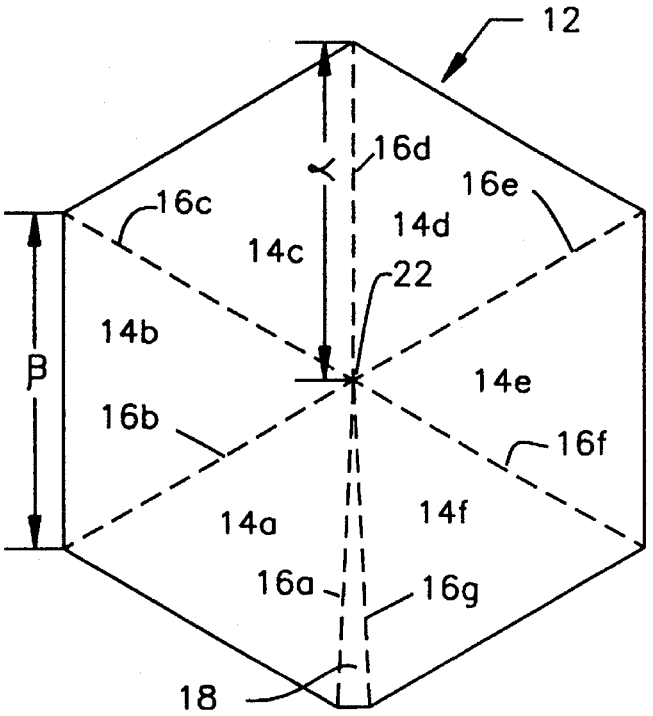
FIG. 2 is a plan view of a single sheet of web material according to one embodiment of the present invention for constructing the umbrella canopy of FIG. 1.

In accordance with a first embodiment of the present invention, as shown in FIG. 2, single sheet 12 of canopy 10 is initially formed in a flat, substantially hexagonal configuration with six integrally formed, identical sectors 14*a*–14*f*. In order to better show such sectors 14*a*–14*f*, radially oriented imaginary lines 16*a*–16*g* are provided which divide single sheet 12 into sectors 14*a*–14*f*, with each imaginary line 16*a*–16*g* extending from the center of canopy 10 to the periphery thereof. Since sheet 12 is made as a single sheet, it is emphasized that lines 16*a*–16*g* are only imaginary and are used only for explanatory purposes. The length $\alpha$ of each imaginary line 16*a*–16*g* is greater than the length $\beta$ of the periphery of each sector, that is $\alpha>\beta$.

An additional tuck sector 18 is formed between the first sector 14*a* and the last sector 14*g*, that is, between imaginary lines 16*a* and 16*g*. Although tuck section 18 is shown to have a central sector angle of approximately 7°, the present invention is not limited thereby.

Figure 4:
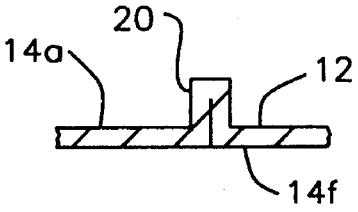
FIG. 4 is a cross-sectional view of the umbrella canopy of FIG. 3, taken along line 4—4 thereof.

It will be appreciated that single sheet 12 is flat with no bowed configuration, and can therefore be easily cut or stamped from a larger sheet of material. In order to impart a bowed configuration thereto, the web material of sheet 12 of tuck sector 18 is pinched together. Specifically, the web material is pinched together such that imaginary lines 16*a* and 16*g* become substantially coincident. Then, the web material is secured thereat to retain imaginary lines 16*a* and 16*g* in such coincident configuration. Preferably, such securement is accomplished by a heat or ultrasonic sealing, although other means may be provided for retaining imaginary lines 16*a* and 16*g* in such coincident configuration, for example, sewing, tacking, adhesion or other securement means. Accordingly, a tuck 20 is formed by the web material within tuck sector 18, as shown in FIGS. 3 and 4.

Figure 3:
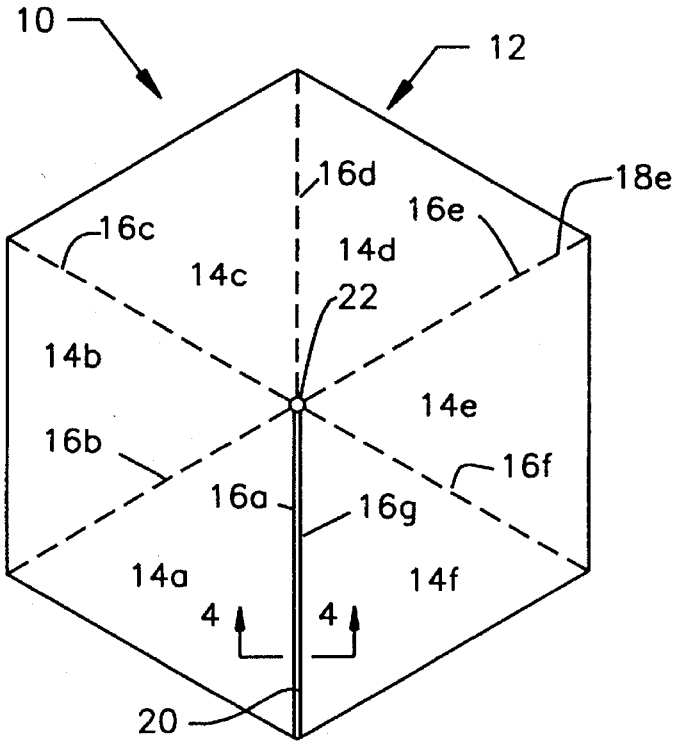
FIG. 3 is a bottom plan view of the umbrella canopy of FIG. 1 formed from the single sheet of web material of FIG. 2.

In this configuration of FIG. 3, a circumferential force is applied to canopy 10, thereby forcing canopy 10 into the bowed configuration of FIG. 1. The amount of bowing or convexity of canopy 10 will depend on the size of tuck sector 18, that is, the larger the central angle of tuck section 18, the larger the convexity of canopy 10.

It will be appreciated that, while the central angle of each sector 14*a*–14*f* is slightly less than 60° prior to the formation of tuck 20, the central angle of each sector 14*a*– 14*f* is equal to 60° after the tuck 20 is formed, due to the elimination of tuck sector 18.

In addition, a small central opening 22 is provided in canopy 10 in order to secure canopy 10 to a handle of an umbrella, as is conventional. Such manner of securement does not form a part of the present invention.

Figure 5:
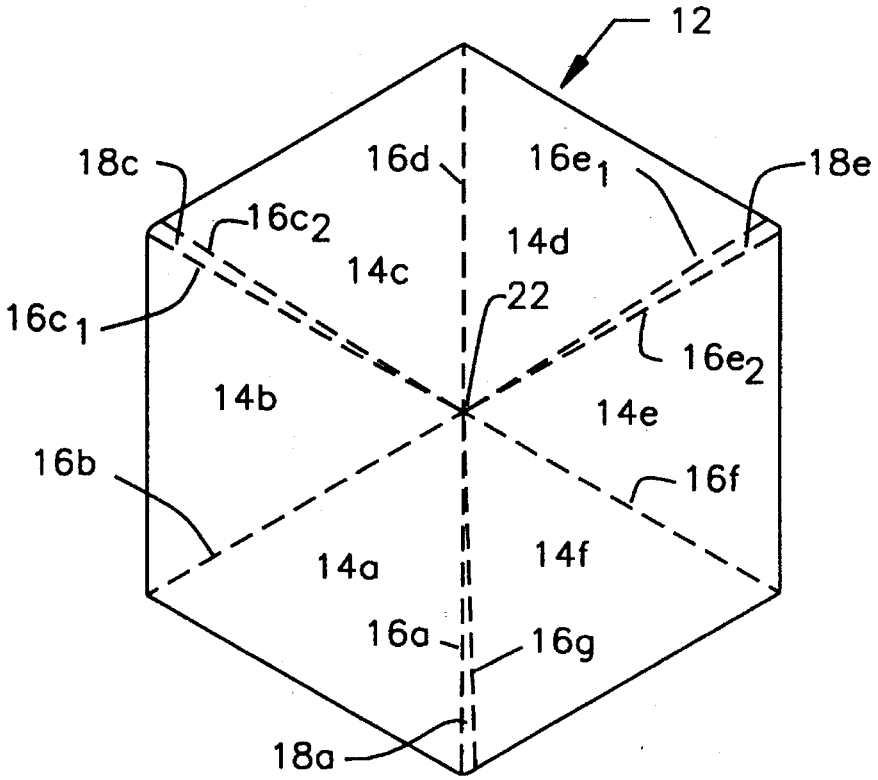
FIG. 5 is a plan view of a single sheet of web material according to another embodiment of the present invention for constructing the umbrella canopy of FIG. 1.
Figure 6:
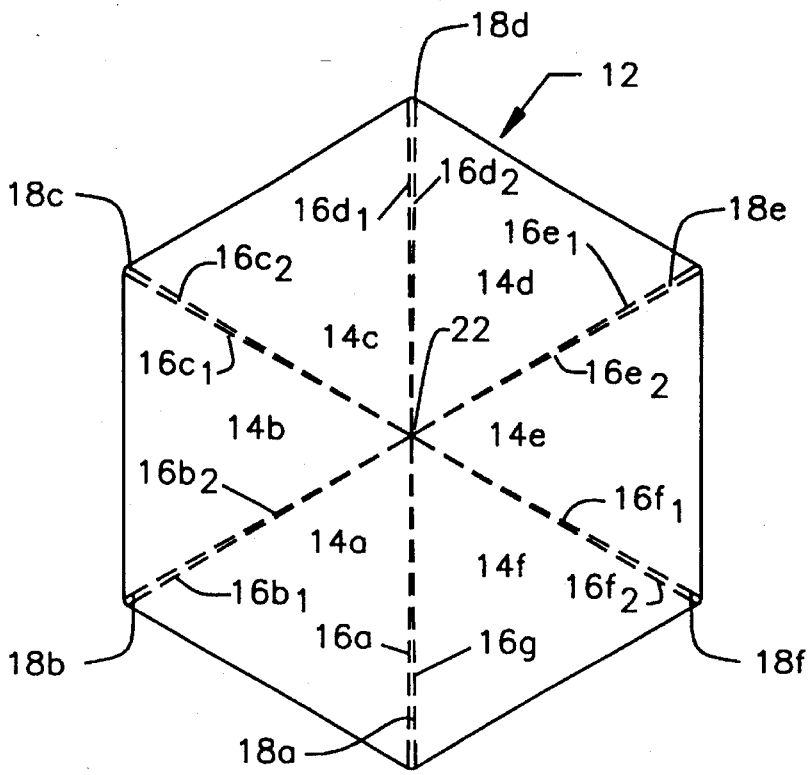
FIG. 6 is a plan view of a single sheet of web material according to still another embodiment of the present invention for constructing the umbrella canopy of FIG. 1.

It will be appreciated that, although one tuck section 18 has been shown in the embodiment of FIGS. 2–4, more than one tuck section 18 may be provided. For example, three tuck sections 18*a*–18*c* can be provided, as shown in FIG. 5, or even six tuck sections 18*a*–18*f* can be provided, as shown in FIG. 6. In the embodiment of FIG. 5, imaginary lines 16*a* and 16*g* define tuck section 18*a*; imaginary lines $16c_1$ and $16c_2$ define tuck section 18*c*; and imaginary lines $16e_1$ and $16e_2$ define tuck section 18*e*. In the embodiment of FIG. 6, imaginary lines 16*a* and 16*g* define tuck section 18*a*; imaginary lines $16b_1$ and $16b_2$ define tuck section 18*b*; imaginary lines $16c_1$ and $16c_2$ define tuck section 18*c*; imaginary lines $16d_1$ and $16d_2$ define tuck section 18*d*; imaginary lines $16e_1$ and $16e_2$ define tuck section 18*e*; and imaginary lines $16f_1$ and $16f_2$ define tuck section 18*f*.

With the embodiments of FIGS. 5 and 6, a single machine can be utilized to simultaneously grip and pinch together tuck sections 18*a*–18*c* of single sheet 12 of FIG. 5 or tuck sections 18*a*–18*f* of single sheet 12 of FIG. 6. With more tuck sections 18 being provided, a more even force is applied to sheet material 12 in the bowed configuration.

Figure 7:
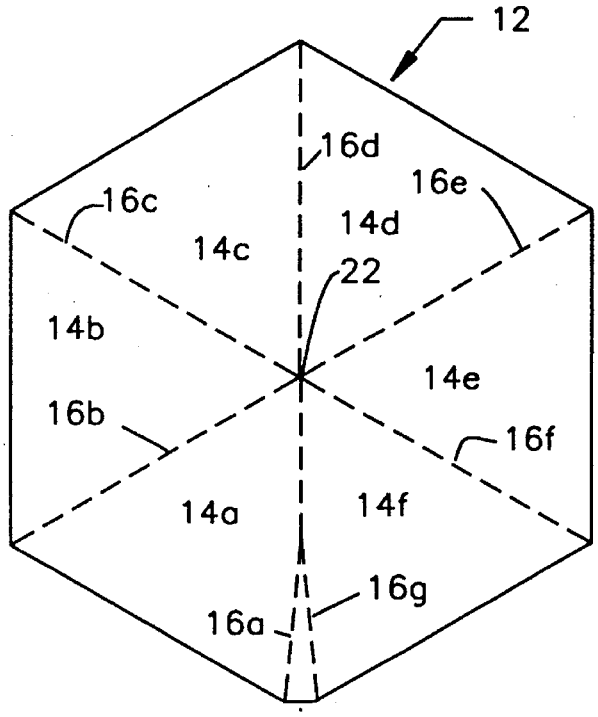
FIG. 7 is a plan view of a single sheet of web material according to yet another embodiment of the present invention for constructing the umbrella canopy of FIG. 1.

In the above embodiments of the present invention, all tuck sections 18 extend from central opening 22 of single sheet 12 to the periphery thereof. However, this need not be the case. For example, as shown in FIG. 7, a tuck section 18 may start at a position outwardly from central opening 22, as measured in the radial direction. In such case, the bowing effect will only be at the periphery of the umbrella canopy which corresponds to the tuck section or tuck sections. It is important, however, that each such tuck section 18 extend to the periphery of single sheet 12. It is also preferable that each tuck section increase in width toward the periphery of single sheet 12, preferably in a triangular, sector-shaped configuration, although it is possible to form each tuck section with a uniform width.

Although the above embodiments utilize tucks 20 to form single sheet 12 into a bowed configuration, it is possible to form a single sheet 12 into a bowed configuration in other ways.

Figure 8:
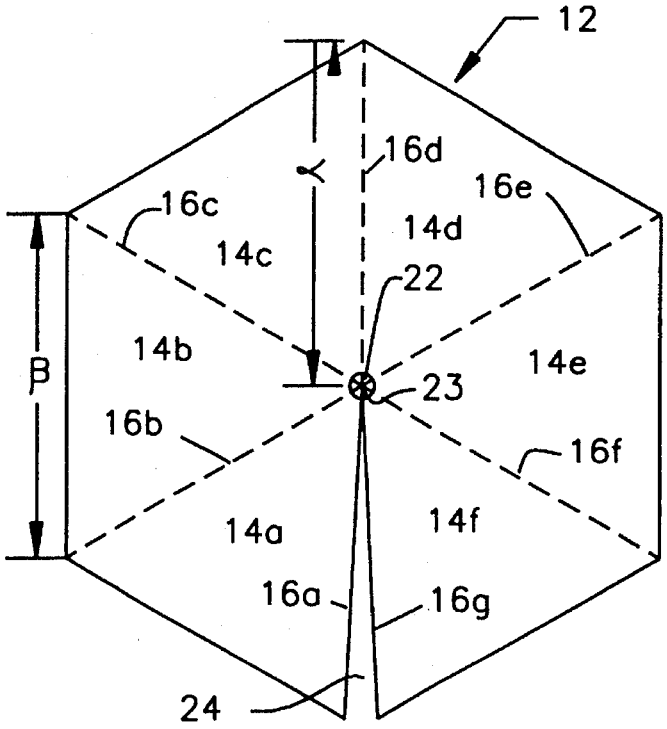
FIG. 8 is a plan view of a single sheet of web material according to a further embodiment of the present invention for constructing the umbrella canopy of FIG. 1.
Figure 10:
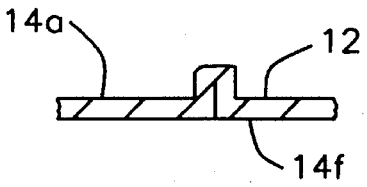
FIG. 10 is a cross-sectional view of the umbrella canopy of FIG. 9, taken along line 10—10 thereof.
Figure 9:
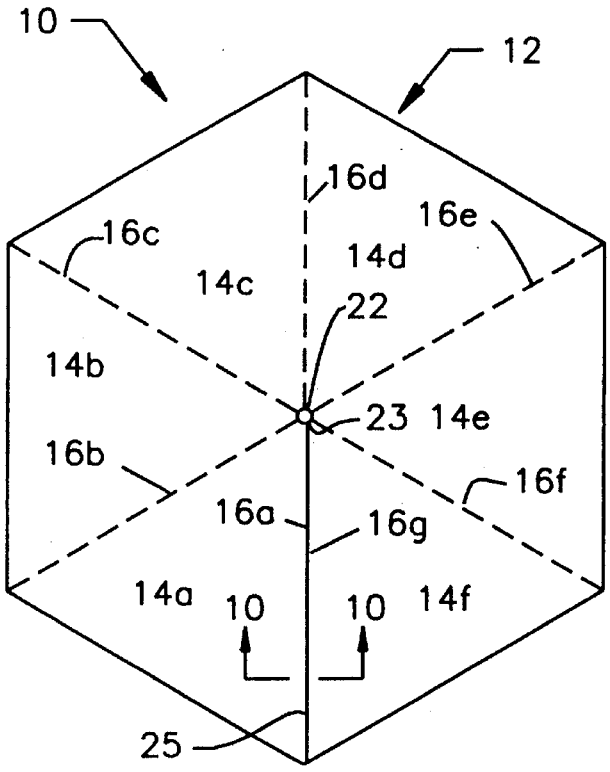
FIG. 9 is a bottom plan view of the umbrella canopy of FIG. 1 formed from the single sheet of web material of FIG. 8.

For example, as shown in FIG. 8, which corresponds to the embodiment of FIG. 2, the area of tuck section 18 is cut-away to define an open area 24. In this case, lines 16*a* and 16*g* define side edges of open area 24. To provide a bowed configuration to single sheet 12, side edges 16*a* and 16*g* are secured together in any suitable means, such as heat or ultrasonic sealing, sewing, tacking, adhesion or other securement means, as shown in FIGS. 9 and 10, to form a radially oriented seam 25. Alternatively, although not shown, open areas 24 can be formed in place of tuck sections 18*a*–18*c* of FIG. 5 or tuck sections 18*a*–18*f* of FIG. 6, with opposite edges of each tuck section being secured together in a similar manner to form three or six seams, respectively.

It will be appreciated that the radially oriented lines that define open areas 24 do not extend entirely to central opening 22, thereby leaving a small circular ring 23 of material in surrounding relation to central opening 22. Otherwise, where there are more than one open area 24, the material bounded between the open areas would not be attached and there would be no single sheet 12 of material to work from.

It will be appreciated that the above embodiment of FIGS. 8–10, and modifications thereto, are different from the prior art in which a plurality of individual segments with convex side edges are sewn together to impart a bowed effect to the canopy. Specifically, by forming the canopy from a single sheet of web material, the problem of arranging and aligning individual segments is avoided, thereby reducing the manufacturing cost and complexity of forming the umbrella canopy. This result is achieved by utilizing a single sheet having a central connecting region with which all of the sectors are connected together and which does not include any seam line. This central connecting region is defined by the circular ring 23 of material surrounding and defining central opening 22 of each sheet 12.

Figure 11:
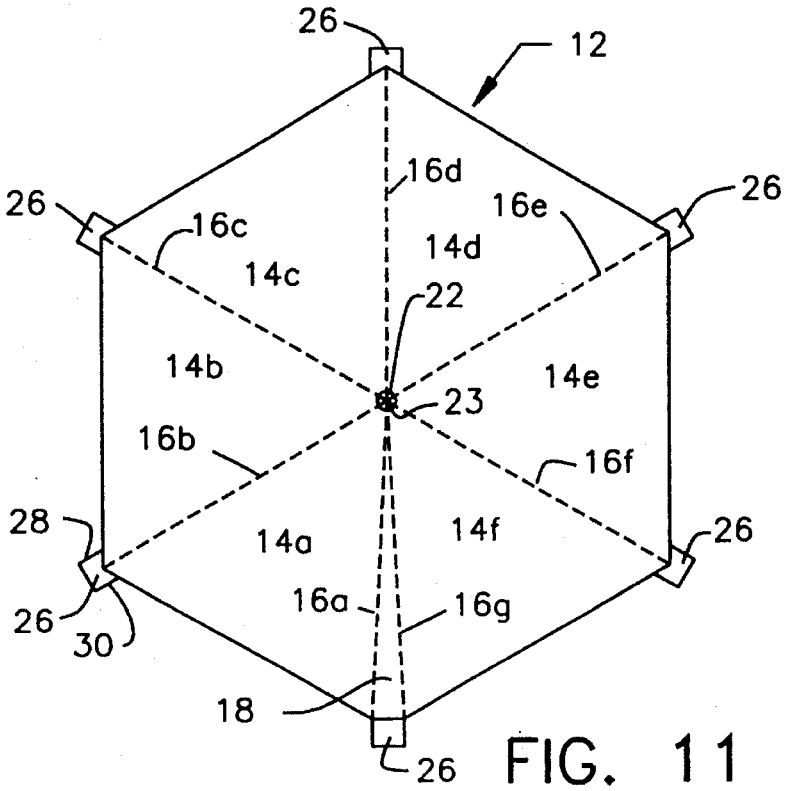
FIG. 11 is a plan view of a single sheet of web material according to a still further embodiment of the present invention for constructing the umbrella canopy of FIG. 1.
Figure 13:
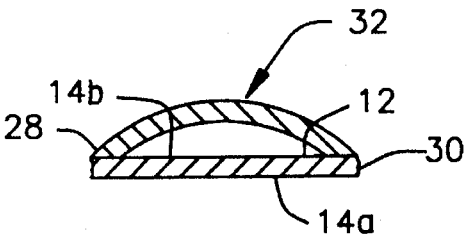
FIG. 13 is a cross-sectional view of the umbrella canopy of FIG. 12, taken along line 13—13 thereof.
Figure 12:
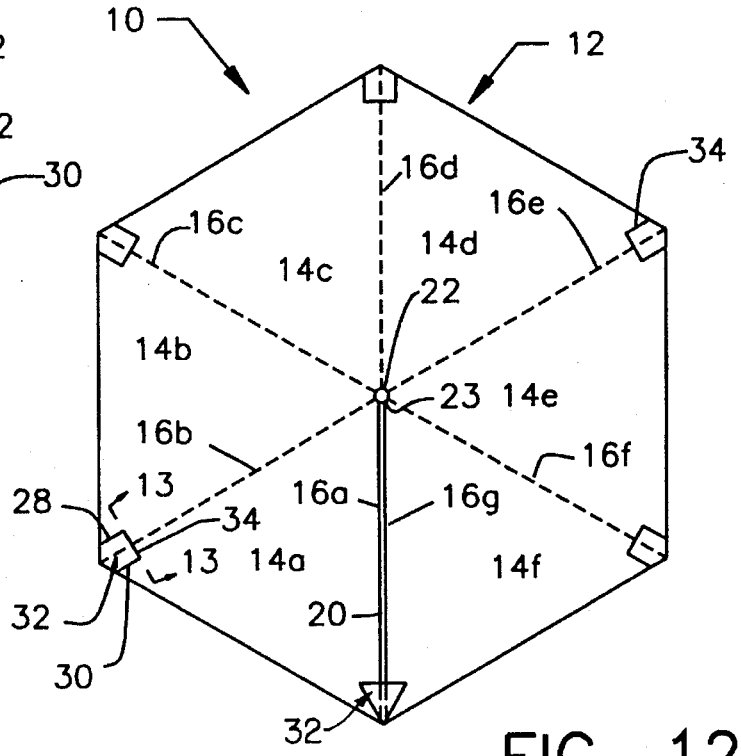
FIG. 12 is a bottom plan view of the umbrella canopy of FIG. 1 formed from the single sheet of web material of FIG. 11.

As still another modification to the present invention, pocket flaps 26 can be provided at each peripheral corner of the hexagonal single sheet 12, as shown in FIG. 11. When folded over and sealed to the bottom of single sheet 12 at opposite edges 28 and 30 thereof, as shown in FIGS. 12 and 13, a pocket 32 is formed, having an opening 34, for receiving the end of a strut of the type disclosed in the aforementioned U.S. Pat. No. 4,842,003 to Baldwin et al and U.S. Pat. No. 4,966,179 to Baldwin.

Still further, in place of the pocket flaps, a peripheral seam (not shown) can extend around the entire periphery and be folded over and heat sealed to provide reinforcement at the periphery. In addition, the pockets can be formed by appropriate seals of the peripheral seam.

It will therefore be appreciated that an umbrella canopy can be formed of a one-piece construction, having bowed configuration, without the need for any strut force thereon. Such an umbrella canopy is easy and economical to manufacture.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. An umbrella canopy comprising a single sheet of web material formed in a closed configuration and having a periphery of a fixed length, said single sheet of web material having a bowed configuration, said single sheet of web material having at least one tuck means, extending inwardly along at least one radially directed line of said umbrella canopy from said periphery thereof, for applying a circumferential force on said single sheet of web material to form said single sheet of web material into said bowed configuration without application of a strut force thereon, each said tuck means comprised of a first portion of said web material which extends in said radial direction being in contact with an adjacent second portion of said web material which extends in said radial direction and which is spaced apart from said first portion prior to formation of said web material into said bowed configuration, with said first and second portions of said web material being secured to each other.

2. An umbrella canopy according to claim 1, wherein said single sheet is formed into a hexagonal configuration having six peripheral apices, and each said tuck means extends to a respective said apex of said hexagonal configuration.

3. An umbrella canopy according to claim 1, wherein said single sheet has a center and a symmetrical configuration about said center, and each said tuck means extends from said center to said periphery.

4. An umbrella canopy according to claim 1, wherein said single sheet has a center and a symmetrical configuration about said center, and each said tuck means extends from a position between said periphery and said center, to a position at said periphery.

5. An umbrella canopy according to claim 1, wherein said single sheet further includes a plurality of pockets at a lower surface thereof, said plurality of pockets formed from flaps secured to said periphery and folded over and secured to said lower surface.

6. An umbrella canopy according to claim 1, wherein said single sheet has a center opening.

7. An umbrella canopy according to claim 1, wherein said single sheet of web material has a polygonal configuration with apices along an outer circumference thereof, and each said radially directed line of said umbrella canopy extends from a center of said polygonal configuration to one said apex.

8. An umbrella canopy comprising a single sheet of web material formed in a closed configuration and having a periphery of a fixed length, said single sheet of web material having a bowed configuration, said single sheet of web material having at least one seam means, extending inwardly along at least one radially directed line of said umbrella canopy from said periphery thereof, for applying a circumferential force on said single sheet of web material to form said single sheet of web material into said bowed configuration without application of a strut force thereon, and said single sheet of material having a central connecting region free of any said seam means, each said seam means comprised of a first edge of said web material which extends in said radial direction secured to an adjacent second edge of said web material which extends in said radial direction and which is spaced apart from said first portion prior to formation of said web material into said bowed configuration.

9. An umbrella canopy according to claim 8, wherein said single sheet of web material has at least one radially oriented cut-away portion which defines an open area having opposite radially oriented edges, and each said seam means includes a securement of said opposite radially oriented edges of each respective said open area.

10. An umbrella canopy according to claim 9, wherein each said open area has a substantially triangular configuration.

11. An umbrella canopy according to claim 10, further including means for securing together said opposite radially oriented edges of each respective said open area.

12. An umbrella canopy according to claim 8, wherein said single sheet is formed into a hexagonal configuration having six peripheral apices, and each said seam means extends to a respective said apex of said hexagonal configuration.

13. An umbrella canopy according to claim 8, wherein said single sheet has a center and a symmetrical configuration about said center, and each said seam means extends from said center to said periphery.

14. An umbrella canopy according to claim 8, wherein said single sheet has a center and a symmetrical configuration about said center, and each said seam means extends from a position between said periphery and said center, to a position at said periphery.

15. An umbrella canopy according to claim 8, wherein said single sheet has a center opening.

16. An umbrella canopy according to claim 8, wherein said single sheet of web material has a polygonal configuration with apices along an outer circumference thereof, and each said radially directed line of said umbrella canopy extends from a center of said polygonal configuration to one said apex.

* * * * *